US009163356B2

(12) United States Patent
Kuik et al.

(10) Patent No.: US 9,163,356 B2
(45) Date of Patent: Oct. 20, 2015

(54) CUSHIONED VINYL FLOOR COVERING

(75) Inventors: Pepijn Kuik, Eerbeek (NL); Edze Jan Visscher, Utrecht (NL); Maarten Van Der Made, Heveadorp (NL)

(73) Assignee: BONAR B.V., Arnhem (NL)

( * ) Notice: Subject to any disclaimer, the term of this patent is extended or adjusted under 35 U.S.C. 154(b) by 467 days.

(21) Appl. No.: 11/597,382

(22) PCT Filed: May 25, 2005

(86) PCT No.: PCT/EP2005/005627

§ 371 (c)(1),
(2), (4) Date: Nov. 22, 2006

(87) PCT Pub. No.: WO2005/118947

PCT Pub. Date: Dec. 15, 2005

(65) Prior Publication Data

US 2008/0038546 A1 Feb. 14, 2008

(30) Foreign Application Priority Data

May 26, 2004 (EP) ..... 04012429

(51) Int. Cl.
*B32B 9/00* (2006.01)
*D06N 7/00* (2006.01)

(52) U.S. Cl.
CPC ..... *D06N 7/006* (2013.01); *Y10T 428/249921* (2015.04); *Y10T 428/269* (2015.01); *Y10T 428/27* (2015.01)

(58) Field of Classification Search
CPC ..... D01F 8/12; D01F 6/62; D01D 5/30; D04H 1/54; D04H 3/00; D04H 3/16; D04H 1/541; D04H 1/549; D04H 1/55; D04H 3/147; Y10T 428/269; Y10T 428/27; Y10T 428/249921; D06N 7/006
USPC ..... 442/341, 361–364; 52/403.1; 428/357, 428/373
See application file for complete search history.

(56) References Cited

U.S. PATENT DOCUMENTS

| | | | | |
|---|---|---|---|---|
| 4,234,366 | A * | 11/1980 | Brewer et al. | 428/207 |
| 4,234,651 | A | 11/1980 | Kuhn et al. | |
| 4,363,845 | A | 12/1982 | Hartmann | |
| 4,402,887 | A * | 9/1983 | Kuriyama et al. | 264/495 |
| 5,082,720 | A | 1/1992 | Hayes | |
| 5,204,170 | A * | 4/1993 | Kuyzin | 442/274 |
| 5,582,913 | A * | 12/1996 | Simons | 428/373 |
| 6,267,843 | B1 * | 7/2001 | Helwig et al. | 162/145 |
| 6,365,001 | B1 * | 4/2002 | Helwig et al. | 162/135 |
| 6,517,676 | B1 * | 2/2003 | Mathur | 162/146 |
| 6,562,173 | B1 * | 5/2003 | Collison et al. | 156/259 |
| 2002/0160677 | A1 | 10/2002 | Loffler et al. | |
| 2004/0209059 | A1 * | 10/2004 | Foss | 428/292.1 |
| 2005/0287334 | A1 * | 12/2005 | Wright et al. | 428/95 |

FOREIGN PATENT DOCUMENTS

| | | | |
|---|---|---|---|
| DE | 101 17 354 | A1 | 10/2002 |
| EP | 1 010 801 | A2 | 6/2000 |
| FR | 2 013 722 | | 4/1970 |
| FR | 2013722 | A * | 4/1970 |
| GB | 2 029 726 | | 3/1980 |

* cited by examiner

*Primary Examiner* — Jeremy R Pierce
(74) *Attorney, Agent, or Firm* — Oliff PLC

(57) ABSTRACT

The invention pertains cushioned vinyl floor coverings. For the production of cushioned vinyl floor coverings non-woven carriers made from glass fibers are currently used. However, handling of floor coverings with glass fiber carriers is quite difficult especially when the covering is laid on stairs or sharp edges. According to the present invention a solution to overcome the disadvantages of the prior art is a cushioned vinyl floor covering comprising a nonwoven carrier that is made from different polymers. The different polymers exist either in separate filaments or together in one filament.

21 Claims, No Drawings

CUSHIONED VINYL FLOOR COVERING

BACKGROUND

The present disclosure pertains to cushioned vinyl floor coverings.

Cushioned vinyl is made by applying several PVC based layers on a carrier, each layer with its own function, for example, impregnation, surface foaming, printing, wear protection and carrier. An important step in the cushioned vinyl process is the foaming step, where the top layer and back layer are being foamed at elevated temperatures and by which the cushioned product is acquired.

Currently wet laid nonwoven glass fleeces are used as carriers in the cushioned vinyl process. They fulfil the requirements to obtain a stable process and a dimensionally stable end product. Moreover, glass fleeces are cheap and can be applied in low weights of about 50 g/m$^2$.

Application of glass fleeces also has disadvantages. Handling of glass fleece may be hazardous to the health of the people concerned. Glass makes the cushioned vinyl product brittle. The product loses its stability already at low elongation levels because of the breaking of the carrier. During installation these elongation levels are often exceeded, especially in corners, on stairs or other places where the product is being folded. The surface becomes uneven at these places. The glass carrier also leads to low tear strength of the product and installers have to be careful not to tear the product, especially on places where cuts have to be made. Transport of cushioned vinyl should not happen without precaution. When a roll is bent too much, the brittle structure causes the roll to break.

For these reasons, the market demands glass free carriers for cushioned vinyl. To overcome the disadvantages that are described, the use of thermoplastic nonwoven carriers can be considered. Application of thermoplastic nonwoven carriers results in much easier and less sensitive installation of the cushioned vinyl product by having higher elongation capacity than glass fleeces. Also thermoplastic nonwoven carriers do not have any negative influence on the health of operators working with these products. Moreover, non woven glass fiber carriers are currently only available in a 4 m width or less. Since producers of cushioned vinyl floor coverings try to satisfy the need for 5 m wide cushioned vinyl floor coverings, there is also a demand for 5 m wide carriers that meet the requirements for cushioned vinyl floor coverings.

Thermoplastic nonwovens are not widely used for cushioned vinyl because of their lower mechanical and thermal stability as compared to glass. Low stability may cause thermal shrinkage, formation of creases and too much loss of product width.

A general demand of carriers for cushioned vinyl is surface regularity, which is necessary to apply the impregnation layer regularly over the full width (4 m-5 m). Furthermore structure openness is needed for penetration of the PVC gel through the carrier in order to have sufficient delamination strength between the top layers and the back cushioned layer. Finally good bonding of the gel to the carrier is needed to have good process speed.

Solutions have been presented for making stable thermoplastic nonwoven carriers for cushioned vinyl but these solutions did not meet with all requirements, either missing an open structure or enough surface regularity or economical attractiveness compared to glass fleece. A possible option to improve the stability by increasing the weight can only be done to a limited extend in order to keep the structure open enough.

Document FR 2,013,722 discloses a nonwoven mat made from nylon (polyamide) filaments with a vinyl chloride coating usable as floor covering. The nonwoven mat is bonded by hydrogen bonds at the points of intersection of the filaments. In this way it seems hardly possible to obtain a carrier with an acceptable stability.

U.S. Pat. No. 4,234,651 discloses a process for the manufacture of a nonwoven product having high shear strength and dimensional stability. This product may be used for cushioned vinyls. The product comprises polyethylene terephthalate (PET) filaments and it exhibits a unit area weight of 150-400 g/m$^2$. Such high unit area weight will make the necessary impregnation quite difficult.

U.S. Pat. No. 4,363,845 discloses a nonwoven fabric made from thermoplastic filaments having a PVC coating that may be used as cushioned vinyl floor covering. Although this nonwoven fabric has high dimensional stability, production is quite laborious as a multiplicity of filament groups and individual filaments must be intermixed and subsequently bonded with a secondary binder. In order to achieve the necessary stability an unit area weight of about 200 g/m$^2$ is required.

It is an object of this disclosure to overcome the disadvantages of the prior art.

SUMMARY

According to the present disclosure, a solution to overcome the described disadvantages of the prior art is a cushioned vinyl flooring comprising a nonwoven carrier characterised in that the nonwoven carrier is made from different polymers and that the different polymers exist either in separate filaments or together in one filament.

EMBODIMENTS

It would therefore be possible that the nonwoven carrier comprises two filament types. The two filament types are predominantly made from different polymers with different melting points, so-called bifil types. The term predominantly as used herein means at least 90%.

It is preferred that the melting points of the two different polymers differ by at least 10° C. More preferably the melting points differ by at least 50° C.

Such a product could also be thermally bonded by subjecting the nonwoven product to a temperature in the range of the melting point of the polymer with the lower melting point. However, this nonwoven product would not be bonded at each crossing point since fibers comprising the polymer with the higher melting point might cross each other. Only crossing points of fibers in a combination high and low melting point or low and low melting point would be bonded and not the crossing points of fibers with high melting point.

A nonwoven carrier made from bicomponent filaments is therefore preferred. The bicomponent filaments of the nonwoven carrier are thermally bonded. Bicomponent filaments are filaments of two polymers of different chemical construction. A basic distinction is being drawn between three types: side by side types, sheath/core types and matrix/fibrill types. In a preferred embodiment the nonwoven carrier is predominantly made from sheath core type filaments.

In another preferred embodiment, the melting points of two polymers building the bicomponent filaments differ by at least 10° C. More preferably the melting points differ by at least 50° C.

In this embodiment, the core acts as the backbone with the sheath being the bonding medium of the backbone. The structure of such a product becomes very stable because the filaments are bonded at each crossing point of the filaments thus creating a nonwoven carrier with the highest quantity of bonding points. The dimensional stability of the nonwoven carrier can be made regular over the length and width by optimizing the filament distribution. This structure gives enough resistance to the high local impregnation pressure needed for obtaining a smooth impregnated surface over the full width. The great number of bonding points provides a stable nonwoven carrier already at low area unit weights while leaving enough open space for penetration of the PVC gel through the nonwoven carrier which ensures good mechanical bonding of the PVC layer to the nonwoven carrier and good adhesion of the subsequently applied cushion layer. The uniform stability of the nonwoven carrier made from bicomponent filaments prevents crease formation and neck-in during the foaming process.

The properties of the described nonwoven carrier made from bicomponent filaments make possible a stable processing at lower weight and thickness as compared to other thermoplastic nonwoven carriers for cushioned vinyl floor coverings.

In a preferred embodiment, the sheath consists mainly of polyamide and the core consists mainly of polyester. In a more preferred embodiment, the sheath consists mainly of polyamide 6 and the core consists mainly of polyethylene terephthalate. Preferably, the sheath/core ratio lies between 95/5% by volume and 5/95% by volume. More preferably, the sheath/core ratio lies between 50/50% by volume and 5/95% by volume.

A low weight of the nonwoven carrier in the range of 40 $g/m^2$-140 $g/m^2$, preferably 50 $g/m^2$-100 $g/m^2$, is needed to keep the carrier open enough for penetration of the impregnation layer and mechanical adhesion of this layer to the carrier. Lower thickness results in less consumption of impregnation material. In this way the bicomponent thermoplastic nonwoven carrier becomes an economically feasible alternative for glass fleece.

A thermally bonded nonwoven material made from bicomponent filaments with a polyester core and a polyamide sheath that is suitable for use in cushioned vinyl floor coverings is sold under the name COLBACK® as carpet carrier. COLBACK® is also available in 5 m width.

What is claimed is:

1. A cushioned vinyl floor covering comprising a nonwoven carrier, wherein the nonwoven carrier is made from different polymers, the different polymers exist in separate filaments and at least two of the separate filaments do not comprise the same polymers, or the different polymers exist in bicomponent filaments, the nonwoven carrier is bonded, wherein the bonding of the nonwoven carrier consists of thermally bonding a polymer originating from the separate or the bicomponent filaments, the nonwoven carrier has a unit area weight of from 40 $g/m^2$ to 140 $g/m^2$, the nonwoven carrier is impregnated with a vinyl gel, and the floor covering remains usable without breaking when bent or formed into a roll.

2. The cushioned vinyl floor covering according to claim 1, wherein the nonwoven carrier is predominantly composed of bicomponent filaments.

3. The cushioned vinyl floor covering according to claim 2, wherein the nonwoven carrier is predominantly composed of sheath/core filaments.

4. The cushioned vinyl floor covering according to claim 2, wherein the nonwoven carrier comprises sheath/core filaments with a sheath/core ratio between 95/5% by volume and 5/95% by volume.

5. The cushioned vinyl floor covering according to claim 2, wherein the nonwoven carrier is predominantly composed of sheath/core filaments having a polyester core and polyamide sheath.

6. The cushioned vinyl floor covering according to claim 1, wherein the nonwoven carrier has a unit area weight of from 50 $g/m^2$ to 100 $g/m^2$.

7. The cushioned vinyl floor covering according to claim 1, wherein the nonwoven carrier is 5 m wide.

8. The cushioned vinyl floor covering according to claim 1, further comprising one or more layers selected from the group consisting of a surface foaming layer, a printed layer, and a wear protection layer.

9. The cushioned vinyl floor covering according to claim 1, wherein the two filament types comprise different polymers where the melting temperatures of the two filament types differ by an amount of 50° C. or greater.

10. A cushioned vinyl floor covering comprising a nonwoven carrier, wherein the nonwoven carrier is made from different polymers, the different polymers exist in separate filaments and at least two of the separate filaments do not comprise the same polymers, or the different polymers exist in bicomponent filaments, the nonwoven carrier is bonded, wherein the bonding of the nonwoven carrier consists of thermally bonding a polymer originating from the separate or the bicomponent filaments, the nonwoven carrier has a unit area weight of from 40 $g/m^2$ to 140 $g/m^2$, the nonwoven carrier is impregnated with a vinyl gel, and the cushioned vinyl floor covering further comprises one or more layers selected from the group consisting of a surface foaming layer, a printed layer, and a wear protection layer.

11. The cushioned vinyl floor covering according to claim 10, wherein the different polymers have melting temperatures that differ by an amount of 50° C. or greater.

12. The cushioned vinyl floor covering according to claim 10, wherein the nonwoven carrier is predominantly composed of bicomponent filaments.

13. The cushioned vinyl floor covering according to claim 12, wherein the nonwoven carrier is predominantly composed of sheath/core filaments.

14. The cushioned vinyl floor covering according to claim 12, wherein the nonwoven carrier comprises sheath/core filaments with a sheath/core ratio between 95/5% by volume and 5/95% by volume.

15. The cushioned vinyl floor covering according to claim 12, wherein the nonwoven carrier is predominantly composed of sheath/core filaments having a polyester core and polyamide sheath.

16. The cushioned vinyl floor covering according to claim 10, wherein the nonwoven carrier has a unit area weight of from 50 $g/m^2$ to 100 $g/m^2$.

17. The cushioned vinyl floor covering according to claim 10, wherein the nonwoven carrier is 5 m wide.

18. A method of covering a floor, comprising:

applying a cushioned vinyl floor covering to the floor, wherein the cushioned vinyl floor covering comprises a cushioned vinyl floor covering according to claim 1.

19. The cushioned vinyl floor covering according to claim 1, wherein the nonwoven carrier consists of the different polymers.

20. The cushioned vinyl floor covering according to claim 10, wherein the nonwoven carrier consists of the different polymers.

21. The method of covering a floor according to claim 18, wherein the nonwoven carrier consists of the different polymers.

* * * * *